United States Patent [19]

Shiang

[11] Patent Number: 4,633,597

[45] Date of Patent: Jan. 6, 1987

[54] ELASTIC PRESSURE AND AUTOMATIC-AIR-VENTILATION TYPE OF INSOLE

[76] Inventor: Joung-Lin Shiang, No. 72, Hu Chu St., Pao-Chiao City, Taipei Shien, Taiwan

[21] Appl. No.: 586,701

[22] Filed: Mar. 6, 1984

[51] Int. Cl.[4] ..... A43B 13/38

[52] U.S. Cl. ..... 36/43; 36/44

[58] Field of Search ..... 36/43, 44

[56] References Cited

U.S. PATENT DOCUMENTS

| | | | |
|---|---|---|---|
| 4,183,156 | 1/1980 | Rudy | 36/44 |
| 4,217,705 | 8/1980 | Donzis | 36/44 |
| 4,219,945 | 9/1980 | Rudy | 36/44 |
| 4,414,760 | 11/1983 | Faiella | 36/43 |
| 4,446,634 | 5/1984 | Johnson | 36/43 |
| 4,476,638 | 10/1984 | Quacquarini | 36/44 |

OTHER PUBLICATIONS

PCT, WO79/00210 Donzis, 3-1979.

*Primary Examiner*—Werner H. Schroeder
*Assistant Examiner*—Mary A. Ellis
*Attorney, Agent, or Firm*—Balogh, Osann, Kramer, Dvorak, Genova & Traub

[57] ABSTRACT

It is an elastic air-sack type of insole, which will make the air inside the shoes circulated by means of restoring effect of the air sack. The air sack insole is made of an elastic film piece being closely attached to the edge of a flat insole. Along the edge of the insole, an auxiliary air tube is mounted. The air-sack type of insole may, if necessary, be installed with a coil spring, or sponge, or a check valve for intake air or exhausting air; instead, a plurality of air tubes disposed abreast or a discrete air sack may be attached to the bottom surface of the insole.

3 Claims, 8 Drawing Figures

7-a 7-b

ELASTIC PRESSURE AND AUTOMATIC-AIR-VENTILATION TYPE OF INSOLE

BACKGROUND OF THE INVENTION

The general shoes such as sports shoes and the regular leather shoes have the drawbacks of non-ventilation, causing moisture, muggy, and unpleasant odor, etc.; these drawbacks would seriously affect the sanitation and atmosphere of an individual and the public. Although some kinds of shoes have been furnished with holes on the vamp and with an insole for absorbing the sweat, such methods are deemed as being unable to remove the drawbacks basically. The holes on the vamp can not positively cause the air inside the shoes to circulate or to exchange with the external air. A plain insole for absorbing the sweat is unable to maintain its function for a prolonged time, and it would hinder the heat dissipation. In other words, the current means to solve the aforesaid drawbacks of shoes can not have any breakthrough improvement because they eliminate one problem, but give rise to another.

SUMMARY OF THE INVENTION

In order to improve the drawbacks of the current shoes, the inventor has developed an elastic or cushioned air-sack type of insole to be mounted in the limited space inside the shoes. When shoes containing insoles of this invention are placed upon the feet, the insoles will automatically absorb and exhaust air in the shoes to generate a ventiling effect, i.e. to have the air in the shoes exchanged with the external air so as to maintain the inside of shoes in a dry and cool condition. The insole of the present invention may be formed as an air sack or a discrete air sack on top of the insole or air tubes being attached under the bottom surface of the insole. Further, in the air sack, a spring or a piece sponge, etc. may be installed for generating additional elasticity. If necessary, the insole may be mounted with a check valve that operates something like an air pump, or with an adjustable tube for air flowing speed and direction to increase the air circulation in the shoes.

BRIEF DESCRIPTION OF THE DRAWINGS

FIG. 8 is a perspective view of an air inlet valve of the present invention.

DETAILED DESCRIPTION

Figure 1:
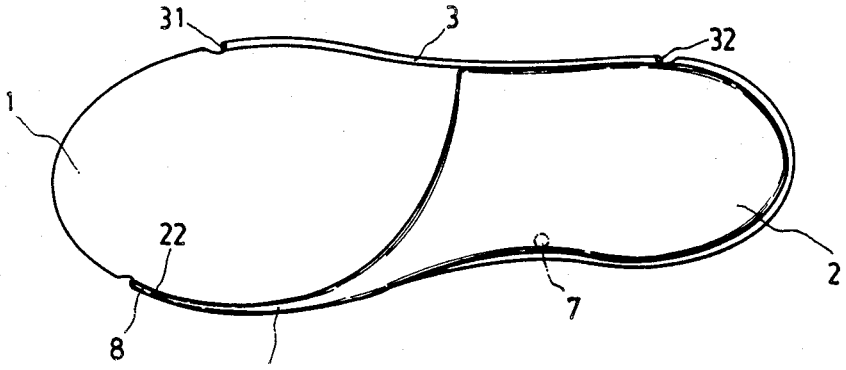
FIG. 1. is a top view of the first embodiment of an air-sack type of insole in the present invention.

Referring to FIG. 1, there is shown a top view of an air-sack type of insole, in which the insole 1 is something like a flat plate; an air sack 2 is made from an elastic film piece in a curved form being closely pressed and fastened to an edge of the insole 1; in the front end of the air sack, an edge tube of air sack 21 having an air orifice 22 at the front end is furnished. On the other side of the insole, an auxiliary air tube 3 having a front air orifice 31 and a rear air orifice 32 is furnished; by means of the front and rear air orifice, the front and rear hollow spaces in a shoe may be communicated with each other so as to have the air in the shoes exchanged with the external air. The air sack 2 may be replaced with discrete or removable air sack so as to meet manufacturing convenience, if necessary. Upon putting this invention in the shoe, the air in the air sack 2 will be pressed out and sucked in as a result of being stepped by the foot so as to have the air in the front space of a shoe flowed; as a result of the air pressure in the shoes, the air inside the shoes will be exchanged between the front and the rear portions of the shoes via the auxiliary air tube 3, and exchanged with the air outside the shoes as well. On the inner edge of the air sack 2, a check valve 7 for intake air (referring to FIG. 8) may, if necessary, be installed, and on the air orifice 22 of air sack 2, a check valve 8 for exhausting air (referring to FIG. 7) may be installed; this way will make the air-sack type of insole being similar to an air pump.

Figure 2:
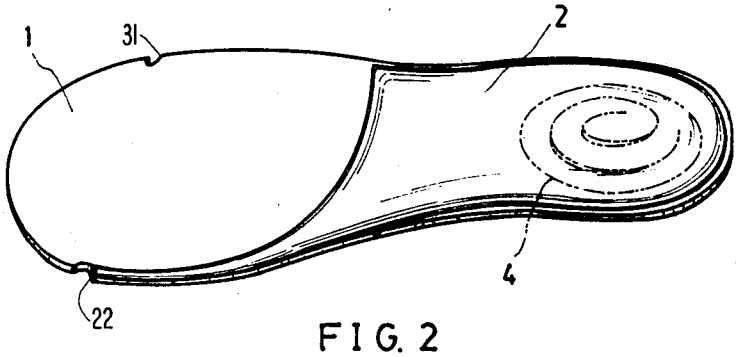
FIG. 2. is a perspective view of the second embodiment of the air-sack type of insole in the present invention.

Referring to FIG. 2, there is shown a perspective view of the second embodiment of the air-sack type of insole in the present invention, in which the air sack 2 is different from that shown in FIG. 1, and the coil spring 4 may or may not be installed depending upon the elasticity of the film piece of the air sack 2 so as to obtain additional rebounding force. The coil spring 4 may be replaced with a means that can serve the purpose mentioned, such as a piece of sponge having grooves; that means is not shown in the Fig. because of it merely being a variety for manufacturing convenience. In this embodiment, the auxiliary air tube shown in FIG. 1 is not used because of it being only provided in a shoe, of which the vamp has ventilation holes.

Figure 3:
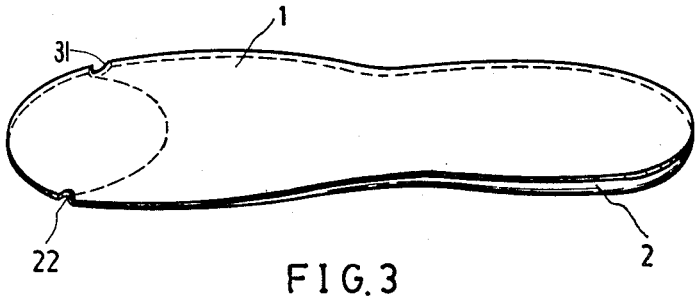
Fig 3. is a perspective view of the third embodiment of the air-sack type of insole in the present invention.

Referring to FIG. 3, there is shown a perspective view of the third embodiment of the air-sack type of the foot pad in the present invention, in which the air sack 2 is installed underneath the insole 1 in order to meet the preference of the user.

Figure 4:
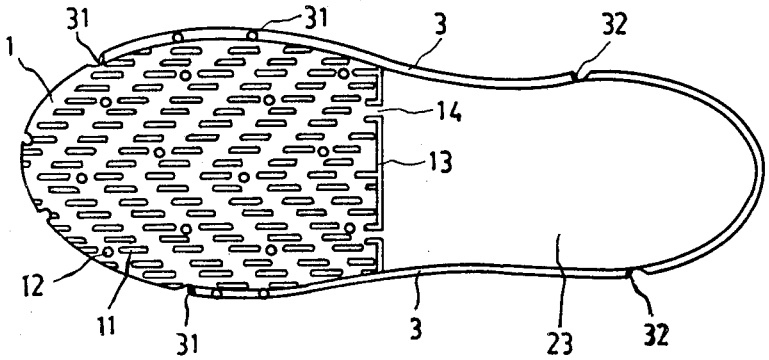
FIG. 4. is a bottom view of an embodiment of a discrete air-sack type of insole in the present invention.

Referring to FIG. 4, there is shown a bottom view of an embodiment of the discrete air-sack type of foot pad in the present invention, in which the bottom surface of the rear portion of the foot pad is formed into a concave shape and the edge is bent downwards vertically like a cover so as to increase the restoring elasticity of the insole; the bottom surface of the front portion of the insole is furnished with a plurality of projected strips 11 and holes 12 so as to have the air above and underneath the insole circulated each other. The discrete air sack 23 is attached to the bottom surface of the rear portion of insole 1, and its orifice is placed in the channel for the air orifice of the discrete air sack 23 on the limiting edge of the discrete air sack 23. Two auxiliary air tubes 3 are attached on both side edges respectively of the insole. The air upon being pressed out of the discrete air sack 23 will flow, through the net-shaped space under the bottom surface of the front portion of insole and via the holes 12, to the top surface of the insole; then, the air will flow via the auxiliary air tube 3 to air orifice 32 for exhausting the rear portion of shoes so as to make an exchange with the air outside the shoes. For example, upon the discrete air sack 23 being restored to its original shape, the air will be sucked in again so as to make an exchange with the air outside the shoes; so that way it will maintain the inside of a shoe always in a dry and cool state. The discrete air sack may be replaced with an air sack for variety purpose.

Figure 5:
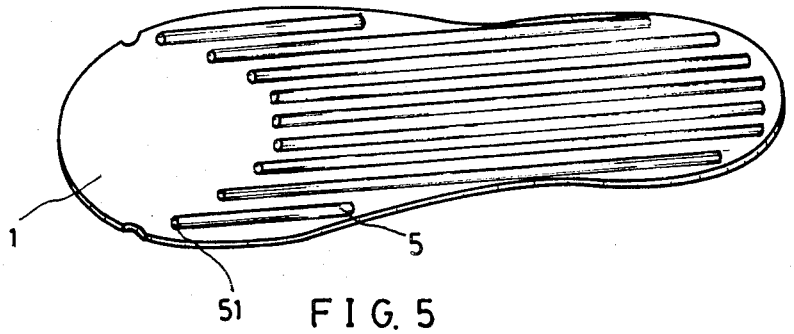
FIG. 5. is a bottom view of an embodiment of an air-tube type of insole in the present invention.

Referring to FIG. 5, there is shown a perspective view of the bottom surface of an embodiment of an air-tube type of insole in the present invention, in which the bottom surface of the insole 1 is provided with a plurality of air tubes 5 being arranged in a suitable space one another. Each of the air tubes 5 has a one-way air orifice 51. Upon the tubes being pressed by the foot, the air in the tube will be exhausted to have the air in the front portion of a shoe flowed so as to generate the same effect as those embodiments mentioned above.

Figure 6:
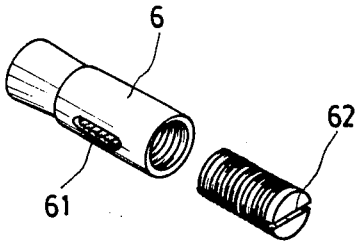
FIG. 6. is a perspective view of an adjustable tube for air flowing speed and direction to be mounted on the air orifice of the air-sack type of insole in the present invention.

Referring to FIG. 6, there is shown a perspective view of an adjusting tube for air flowing speed and direction 6 to be mounted on the orifice of the air-sack type of insole in the present invention, in which the inner surface of the adjusting tube for air flowing speed and direction 6 is furnished with threads; on one side of the adjusting tube, there is furnished a slot 61. The size of the slot 61 may be adjusted by means of an adjusting screw 62 to move in or out. The adjusting tube for air flowing speed and direction 6 may be mounted on the orifice of the air sack for adjusting the jetting strength and direction of the air. The air sack may be sealed completely by closing the slot 61 with the adjusting screw 62; then, the air sack will become an elastic pad to massage the foot sole. This pad is particularly useful in winter season because of its heat-insulting and warm-maintaining characteristics.

Figure 7:
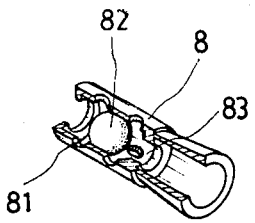
FIG. 7. is a perspective and sectional view of one-way air outlet valve in the present invention.
Figure 7:
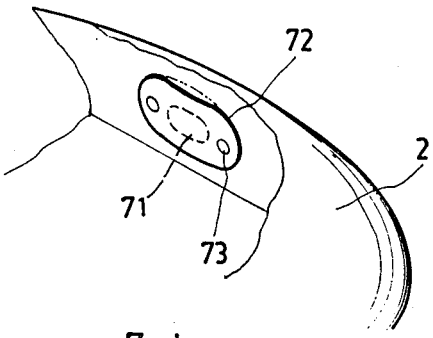

FIGS. 7 and 8 illustrates the perspective views of a check valve for intake air and a check valve for exhausting air, in which FIG. 7 illustrates the check valve for exhausting air 8, which includes a steel ball 82. The tail of the check valve 8 is mounted inside the orifice of the air sack. Upon the air being squeezed out of the sack, the steel ball 82 will be pushed towards top end of the check valve, and the air will be exhausted out of the air outlet 83 and the mesh holes 81. Upon the air sack being released from the squeezing pressure, the steel ball 82 will be sucked back to close the air outlet 83, in other words, the check valve can only exhaust the air. FIG. 8 illustrates the check valve for intake air that is mounted in a position shown in FIG. 1. This check valve for intake air 7 includes a thin film 72 being attached to the inside of air inlet 71 of the air sack. The thin film 72 and the air sack are attached together at two points 73 with adhesive or heat pressure. Upon the air sack being inflated, the outer air will push the thin film 72 inwards a little bit so as to have the air flow into the air sack 2 through the side gap of that valve; upon the air sack being squeezed, the air inside the sack would have the thin film 72 closely attached to the air inlet 71 for preventing the air from bleeding out. The aforesaid two check valves may, if necessary, be installed in a pad together so as to have the air inside and outside the shoes fully exchanged for maintaining a dry and cool air in the shoes. The check valve for exhausting air may be replaced with a slit directly formed on the air orifice of the air sacks; from that slit, the air can be exhausted out, but the slit will be closed automatically without taking in air upon the air sack restoring to its original shape.

This invention may be designed into several different embodiments so as to adapt to various kinds of shoes satisfactorily. The features of the present invention are as follows:

1. The discrete air sack and the air sack may be replaced each other for facilitating the manufacturing and use convenience. The air sack is made of the film piece and the insole being attached together, and in the air sack, a coil spring or sponge may be installed inside to increase the elasticity of the sack. The discrete air sack looks like a flat balloon, being formed integrally, and then is attached on the insole; nothing is put inside for increasing its elasticity, i.e. only its own elasticity.

2. The air tube of the air sack or the inner air sack may be made integrally or separately with a hose inserted or adhered thereto.

3. The auxiliary air tube may be installed if necessary; its primary function is to have the air inside and outside the shoes interchanged.

4. The function of the adjusting tube of air flowing speed and direction is to increase the jetting strength and to change the jetting direction of the air. The orifice of the air tube may directly be formed into a rigid flat slit to increase the jetting speed of air.

5. The check valves for intake air and exhausting air operate like a pump so as to maintain the air inside the shoes dry and cool.

6. During walking, the air inside the air sack or inner air sack not only can make the inner air circulating, but also can provide a massage effect to the foot sole. The reason is that, upon walking, one's foot soles will apply a pressure to the sole. Upon one's foot being lifted, the foot heel may be separated from the shoe heel, or the whole foot sole may be separated from the insole; as a result, the air inside the inner air sack or the air sack may be like a bubble to move back and forth to provide the foot sole with a mobile local massage effect.

7. The orifice of the air sack or discrete air sack may be sealed by a user to make the air sack or discrete air sack similar to a sealed air bubble for increasing the massage effect.

I claim:

1. An air-ventilation type of insole having a front portion and a rear portion, and comprising:

an elastic air sack formed in said rear portion and having a pair of opposed side edges;

a first ventilation means disposed adjacent one of said side edges and connected to said air sack for exhausting of air; and second ventilating means adjacent the other of said side edges and connected to said air sack for intake of air, whereby periodic application and release of pressure to said air sack will cause air movement across said insole between both of said ventilation means.

2. An air-ventilation type of insole as claimed in claim 1, wherein said first ventilating means is in the form of an exhausting check valve and said second ventilating means is in the form of an intake valve.

3. An air ventilation type of insole, as claimed in claim 2, including means for controlling the flow of air through said valves.

* * * * *